US010508663B2

(12) United States Patent
Cowan et al.

(10) Patent No.: US 10,508,663 B2
(45) Date of Patent: Dec. 17, 2019

(54) HYDRAULIC CIRCUIT FOR CONTROLLING A MOVABLE COMPONENT

(71) Applicant: National Oilwell Varco, L.P., Houston, TX (US)

(72) Inventors: Richard W. Cowan, Louisville, KY (US); Frank Benjamin Springett, Spring, TX (US); James William Weir, Houston, TX (US); Travis James Miller, Cypress, TX (US); James Landrith, Humble, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 16/071,601

(22) PCT Filed: Jan. 27, 2017

(86) PCT No.: PCT/US2017/015221

§ 371 (c)(1),
(2) Date: Jul. 20, 2018

(87) PCT Pub. No.: WO2017/132433

PCT Pub. Date: Aug. 3, 2017

(65) Prior Publication Data

US 2019/0055963 A1 Feb. 21, 2019

Related U.S. Application Data

(60) Provisional application No. 62/340,740, filed on May 24, 2016, provisional application No. 62/288,609, filed on Jan. 29, 2016.

(51) Int. Cl.

| | |
|---|---|
| ***F15B 13/02*** | (2006.01) |
| ***F15B 11/08*** | (2006.01) |
| ***F15B 13/042*** | (2006.01) |

(52) U.S. Cl.
CPC ..... *F15B 11/08* (2013.01); *F15B 13/027* (2013.01); *F15B 13/0426* (2013.01);
(Continued)

(58) Field of Classification Search
CPC ..... F15B 11/08; F15B 11/13; F15B 13/027; F15B 13/0405; F15B 13/426;
(Continued)

(56) References Cited

U.S. PATENT DOCUMENTS

| | | | |
|---|---|---|---|
| 4,682,913 | A | 7/1987 | Shatto et al. |
| 5,143,483 | A | 9/1992 | Petersen |

(Continued)

FOREIGN PATENT DOCUMENTS

| | | | |
|---|---|---|---|
| AU | 2011250707 | A1 | 5/2013 |
| GB | 1601582 | A | 11/1981 |

(Continued)

OTHER PUBLICATIONS

International Search Report and Written Opinion dated Jan. 27, 2017; 14 pages.

*Primary Examiner* — Michael Leslie
(74) *Attorney, Agent, or Firm* — Pierre Campanac; Porter Hedges LLP

(57) ABSTRACT

Hydraulic circuits for controlling a movable component use one or more of a plurality of fluid supplies. Pressurized fluid flowing from one supply is routed toward the component and is not inadvertently vented into another fluid supply, or into an exit port. A backflow path is provided for fluid returning from the hydraulic component when the component is actuated in a reversed direction. The hydraulic circuits can be used, for example, on blowout preventers in a subsea environment.

16 Claims, 9 Drawing Sheets

(52) U.S. Cl.
CPC ..... *F15B 2211/20576* (2013.01); *F15B 2211/3052* (2013.01); *F15B 2211/3057* (2013.01); *F15B 2211/30505* (2013.01); *F15B 2211/31582* (2013.01); *F15B 2211/329* (2013.01); *F15B 2211/7053* (2013.01)

(58) Field of Classification Search
CPC .. F15B 2211/20576; F15B 2211/30505; F15B 2211/31582
See application file for complete search history.

(56) References Cited

U.S. PATENT DOCUMENTS

| | | | | |
|---|---|---|---|---|
| 5,261,232 | A | 11/1993 | Maffini et al. | |
| 5,738,172 | A | 4/1998 | van Mook et al. | |
| 6,192,680 | B1 | 2/2001 | Brugman et al. | |
| 6,257,268 | B1 | 7/2001 | Hope et al. | |
| 6,655,405 | B2 * | 12/2003 | Hollister | E21B 34/02 137/102 |
| 8,464,525 | B2 * | 6/2013 | Springett | E21B 33/064 166/352 |
| 9,903,394 | B2 * | 2/2018 | Brahmer | B30B 15/161 |
| 2002/0100501 | A1 | 8/2002 | Hollister et al. | |
| 2004/0154804 | A1 | 8/2004 | Williams | |
| 2009/0095464 | A1 | 4/2009 | McGrath et al. | |
| 2011/0088909 | A1 | 4/2011 | Hamblin et al. | |
| 2011/0098646 | A1 | 4/2011 | Moellenberg et al. | |
| 2011/0098946 | A1 * | 4/2011 | Curtiss, III | E21B 34/16 702/50 |
| 2012/0132436 | A1 | 5/2012 | Judge | |
| 2012/0186820 | A1 | 7/2012 | Donahue et al. | |
| 2012/0216889 | A1 | 8/2012 | Eide et al. | |
| 2014/0048274 | A1 | 2/2014 | Reynolds et al. | |
| 2014/0048275 | A1 | 2/2014 | Reynolds et al. | |
| 2014/0374118 | A1 | 12/2014 | Landrith, II et al. | |
| 2015/0001426 | A1 | 1/2015 | Thompson et al. | |
| 2015/0129233 | A1 | 5/2015 | Gaude et al. | |
| 2015/0136408 | A1 | 5/2015 | Wright | |

FOREIGN PATENT DOCUMENTS

| | | |
|---|---|---|
| GB | 2227776 A | 8/1990 |
| GB | 2433565 A | 6/2007 |

* cited by examiner

HYDRAULIC CIRCUIT FOR CONTROLLING A MOVABLE COMPONENT

This application is a U.S. national stage application under 35 U.S.C. § 371 of PCT Application No. PCT/US2017/015221, filed on Jan. 27, 2017, which claims priority to U.S. Provisional Application Ser. No. 62/288,609, filed on Jan. 29, 2016, and to U.S. Provisional Application Ser. No. 62/340,740, filed on May 24, 2016, both of which are incorporated by reference herein for all purposes.

BACKGROUND

This disclosure relates to methods and apparatus for controlling the movement or position of a hydraulic component using one or more of a plurality of fluid supplies. The hydraulic component may be a piston, a ram, a plunger, a valve, among other components.

A hydraulic circuit 200 that may be part of a blowout preventer is illustrated in FIG. 1. Typically in blowout preventers, pressurized hydraulic fluid is employed to close or open shearing rams or gate valves. In the example shown in FIG. 1, the pressurized hydraulic fluid acts on a piston of a hydraulic component 212, for example for controlling a gate valve. Moreover, in blowout preventers, multiple control systems may be used to control the same hydraulic component. For example, the multiple control systems may be located in different control pods of the blowout preventer. In the example shown in FIG. 1, each control pod may include an independently pressurized fluid supply 214 to control the hydraulic component 212.

For ensuring proper functioning of the hydraulic component, it is important that pressurized fluid flowing from one fluid supply 214 is routed toward the hydraulic component 212. In particular, the pressurized fluid shall not inadvertently crossflow into another fluid supply 214 configured to also control the same hydraulic component 212. Shuttle valves 220 may be used for this purpose. In cases where only one control pod is active at a time, shuttle valves 220 may properly route the pressurized fluid from the one fluid supply 214 located in the active control pod toward the hydraulic component 212. However, the shuttle valves 220 may not be sufficient to prevent crossflow between two fluid supplies 214 that are active at the same time.

Additionally, the pressurized fluid shall not be inadvertently vented into a venting port, such as into venting port 226 when one of the fluid supplies 214 is active. However, a backflow path through the venting port 226 may be provided for discharging hydraulic fluid escaping from the hydraulic component 212 when the hydraulic component is actuated in a reversed direction. In the example shown in FIG. 1, the piston of the hydraulic component 212 may be retracted by activating the fluid supply 215, and by discharging the hydraulic fluid in the extend chamber of the hydraulic component 212 through the venting port 226. To adequately control the discharge of hydraulic fluid via the venting port 226, a pilot-to-open check valve 266 may be configured to permit the discharge of the hydraulic fluid from the extend chamber of the hydraulic component 212 through the venting port 226 only when the piston of the hydraulic component 212 is being retracted. The check valve 266 is only opened by fluid pressure in a pilot line 224. Conversely, a pilot-to-open check valve 267 may be configured to permit the discharge of the hydraulic fluid from the retract chamber of the hydraulic component 212 through the venting port 227 only when the piston of the hydraulic component 212 is being extended. The check valve 267 is only opened by fluid pressure in a pilot line 225. Therefore, at any time during operation of the hydraulic circuit 200, the hydraulic fluid in either the pilot line 224 or the pilot line 225 remains trapped at a high pressure. When a blowout preventer operating in the subsea environment is retrieved to the surface, the pressure differential between the fluid trapped in one of the pilot lines and the environment of the blowout preventer may reach an excessive level, endangering the safety of personnel working on the retrieved blowout preventer.

Thus, there is a continuing need in the art for methods and apparatus for controlling a movable component, in particular, a component of a blowout preventer, using one or more of a plurality of fluid supplies. These methods and apparatus preferably permit two or more of the plurality of fluid supplies to be active at the same time while reducing crossflow between the fluid supplies. Also, these methods and apparatus can mitigate the risk of trapping hydraulic fluid at high pressure. For example, these methods and apparatus can be used on blowout preventers operated in the subsea environment. In such cases, these methods and apparatus can mitigate the risk of reaching excessive pressure differential in the controlling apparatus or elsewhere in the blowout preventer during the retrieval of the blowout preventer to the surface.

BRIEF SUMMARY OF THE DISCLOSURE

The disclosure describes methods of controlling a movable component using one or more of a plurality of fluid supplies. The methods involve fluidly coupling a function port to the component. The methods further involve fluidly coupling a valve, which may herein be referred to as the main valve, between the function port and a venting port. The main valve has a first position wherein the main valve prevents flow between the function port and the venting port and a second position wherein the main valve allows flow between the function port and the venting port. The methods further involve providing a pressure path between at least one of the plurality of fluid supplies and the main valve. The methods further involve shifting the main valve in the second position upon removing pressure in the pressure path. And the methods further involve shifting the main valve in the first position upon supplying pressure in the pressure path.

The methods may further involve flowing fluid from at least one of the plurality of fluid supplies into the function port sequentially after the valve being shifted in the first position.

The methods may further involve preventing fluid backflow toward any of the plurality of fluid supplies using one or more check valves. In order to reduce or remove the pressure in the pressure path, these methods may further involve using a bounce check valve to at least partially dissipate the pressure trapped behind one of the one or more check valves.

In some methods, removing pressure in the pressure path to shift the main valve in the second position may comprise removing pressure from all of the plurality of fluid supplies, and supplying pressure in the fluid communication to shift the main valve in the first position may comprise supplying pressure with any of the plurality of fluid supplies.

The disclosure also describes hydraulic circuits for controlling a movable component using one or more of a plurality of fluid supplies. The hydraulic circuits comprise a function port in fluid communication with the movable component, a venting port, and a valve fluidly coupled between the function port and the venting port. Herein, the valve may be referred to as the main valve. The main valve has a first position wherein the main valve prevents flow between the function port and the venting port, and a second position wherein the main valve allows flow between the function port and the venting port. The hydraulic circuits further comprise a pressure path between the plurality of fluid supplies and the main valve. The main valve is normally in the second position upon removing pressure in the pressure path.

Some of the hydraulic circuits may further comprise a plurality of check valves, each one of the plurality of check valves being fluidly coupled to a corresponding one of the plurality of fluid supplies and oriented to prevent fluid backflow toward the corresponding fluid supply. The plurality of check valves may comprise one or more bounce check valves.

BRIEF DESCRIPTION OF THE DRAWINGS

For a more detailed description of the embodiments of the disclosure, reference will now be made to the accompanying drawings, wherein.

DETAILED DESCRIPTION

Figure 1:
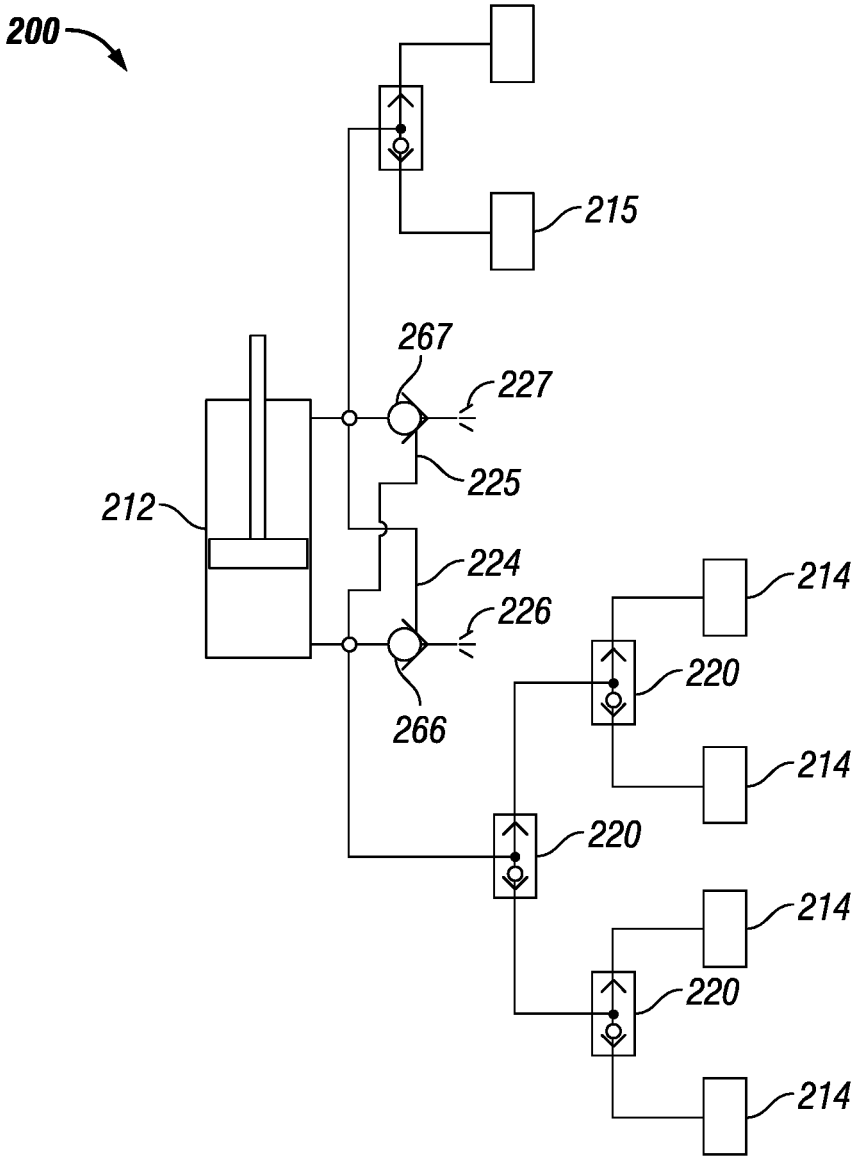
FIG. 1 is a schematic of a hydraulic circuit in accordance with the prior art.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Finally, the exemplary embodiments presented below may be combined in any combination of ways, i.e., any element from one exemplary embodiment may be used in any other exemplary embodiment, without departing from the scope of the disclosure.

Additionally, in the following discussion and in the claims, the terms "including" and "comprising" are used in an open-ended fashion, and thus should be interpreted to mean "including, but not limited to." Furthermore, as it is used in the claims or specification, the term "or" is intended to encompass both exclusive and inclusive cases, i.e., "A or B" is intended to be synonymous with "at least one of A and B," unless otherwise expressly specified herein.

All numerical values in this disclosure may be exact or approximate values unless otherwise specifically stated. Accordingly, various embodiments of the disclosure may deviate from the numbers, values, and ranges disclosed herein without departing from the intended scope. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. As used herein, two elements are said to be fluidly coupled or in fluid communication when a flowpath is provided between the two elements. For example, significant volumes of hydraulic fluid may be transported from one element to the other via the flowpath. However, fluid pressure may or may not be transmitted between the two elements, depending on pressure drops along the flowpath. As used herein, two elements are said to be in pressure communication when pressure applied to hydraulic fluid in one element is transmitted to the other element without necessarily transporting significant volumes of hydraulic fluid between the two elements. As used herein, a valve is said to be normally in a position when it is induced to shift to the position. For example, the valve may be induced to shift to the position using fluid flow in the valve, or it may be forcibly shifted to the position using a spring or equivalent. As used herein, pressure pilots a reciprocating member, including the reciprocating member of a valve, when the pressure exerts, either directly or indirectly, a force on the reciprocating member in the direction of reciprocation, and determine the position of the reciprocating member. As used herein, a bounce check valve includes a vessel, a piston separating two chambers of the vessel, and a valve in fluid communication between the two chambers. Fluid flow through the valve is restricted to one direction. As used herein, a venting port refers to a port that provides an opening for the discharge of hydraulic fluid from at least a portion of the hydraulic circuit. As used herein, a shuttle valve refers to a valve including a non-hollow member, the shuttle, reciprocating within a valve body. The valve body has at least three ports. First and second ports are selectively in fluid communication with the third port. As used herein, a flow gate generates a pressure buildup before fluid can flow through the gate. For example, the flow gate may exhibit a cracking pressure.

Figure 2:
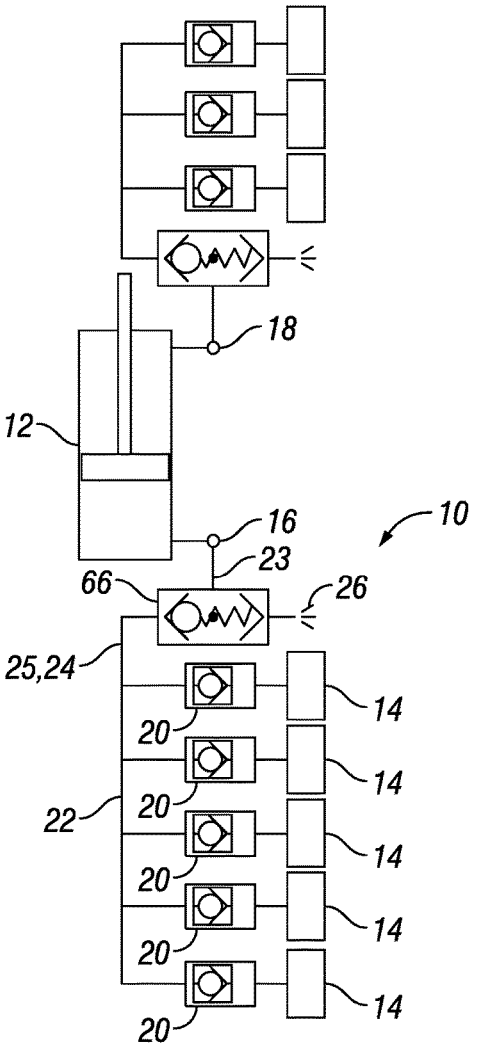
FIG. 2 is a schematic of a hydraulic circuit in accordance with an embodiment.

FIG. 2 is a schematic showing an example of a hydraulic circuit 10. The hydraulic circuit 10 uses one or more of a plurality of fluid supplies 14 for controlling a movable component 12. The number of fluid supplies 14 that may be used for controlling the movable component 12 is not limited to five as illustrated in FIG. 1. The movable component 12 may be, for example, a component of a blowout preventer, such as a shearing ram, a gate valve, a sealing element, or another hydraulically actuated component.

However, in other examples, the hydraulic circuit 10 may be used to expand, inflate sealing elements, or otherwise actuate hydraulic components.

The hydraulic circuit 10 comprises a first function port 16 fluidly coupled to, or in fluid communication with, the component 12. The hydraulic circuit 10 optionally comprises a second function port 18 fluidly coupled to, or in fluid communication with, the component 12. For example, the first function port 16 and the second function port 18 may be fluidly coupled to piston chambers. Pressurized hydraulic fluid flowing into the first function port 16 actuates the component 12 in a first direction, for example, to close a gate valve of the blowout preventer, and expels hydraulic fluid stored in a chamber of the component 12 through the second function port 18. Conversely, pressurized hydraulic fluid flowing into the second function port 18 may actuate the component 12 in a second, reversed direction, for example, to open the gate valve of the blowout preventer, and expel hydraulic fluid stored in another chamber of the component 12 through the first function port 16.

The hydraulic circuit 10 further comprises a venting port 26 The venting port 26 may permit discharging fluid into the environment of the blowout preventer.

The hydraulic circuit 10 further comprises a valve including at least one main valve, such as a shuttle valve 66 that is fluidly coupled between the function port 16 and the venting port 26. The main valve has a first position, wherein the main valve prevents flow between the function port 16 and the venting port 26, and a second position, wherein the main valve allows flow between the function port 16 and the venting port 26.

The hydraulic circuit 10 further comprises a pressure path between at least one of the plurality of fluid supplies and the valve. For example, the pressure path may comprise a pilot line 24 having fluid therein.

The pressure level in the pressure path pilots a reciprocating member of the main valve and determines the position of the main valve. That is, the main valve is normally in the second position upon reducing or removing pressure in the pressure path, and the main valve is shifted to the first position upon supplying pressure in the pressure path.

The hydraulic circuit 10 may further comprise a plurality of check valves. Each one of the plurality of check valves 20, is coupled to a corresponding one of the plurality of fluid supplies 14 and oriented to prevent fluid backflow toward the corresponding fluid supply. The hydraulic circuit 10 may further comprise a merging flowline 22 fluidly coupling the plurality of check valves 20. The merging flowline 22 may be in fluid communication between the plurality of fluid supplies downstream of the plurality of check valves 20.

In the example of FIG. 2, the main valve is fluidly coupled to the function port 16 via a flowline referred to herein as a port flowline 23. A supply flowline 25 is in fluid communication between the merging flowline 22 and the main valve. The pilot line 24 is connected between the merging flowline 22 and the main valve, upstream of the supply flowline 25. Note that the pilot line 24 is also the supply flowline 25, and thus a single conduit provides the function of piloting the main valve and fluidly coupling the function port 16 and the merging flowline 22 when the main valve is in the first position.

In operation, one or more of the plurality of fluid supplies 14 are used to control the movable component 12. One or more of the plurality of fluid supplies 14 may generate a flow of pressurized hydraulic fluid toward the first function port 16 through one or more of the plurality of check valves 20. The plurality of check valves 20 may ensure that the flow of hydraulic fluid from one of the fluid supplies 14 is not vented into another of the fluid supplies 14 regardless of whether the other of the fluid supplies 14 is or is not activated.

Under pressure from fluid from the at least one fluid supply 14, the main valve is shifted to the first position, that is, the main valve prevents flow between the function port 16 and the venting port 26. Preferably, hydraulic fluid flows from at least one of the plurality of fluid supplies into the function port 16 sequentially after the main valve is shifted in the first position. Thus, the flow of pressurized hydraulic fluid is routed to the first function port 16.

To flow hydraulic fluid from the at least one of the plurality of fluid supplies 14 into the function port 16 sequentially after the main valve is shifted in the first position, the main valve initially prevents flow through the supply flowline 25 when in the second position. Upon supplying pressure in the pressure path (i.e., in the pilot line 24), the pressure pilots the main valve and shifts the main valve to the first position. Only then, when the venting port 26 is sealed, hydraulic fluid may flow from at least one of the plurality of fluid supplies 14, through the main valve, through the port flowline 23, and into the function port 16.

To remove the pressure in the pressure path (i.e. in the pilot line 24), pressure from all of the plurality of fluid supplies 14 may first be removed. Then, the pressure trapped between the check valves 20 and the main valve may also be dissipated so that the main valve may shift back to the second position, which is its normal position, for example upon the action of a spring. To dissipate at least partially the pressure trapped between the check valves 20 and the main valve, one or more of the check valves 20 may be implemented as bounce check valves, as explained in the description of FIGS. 14A-14C for example.

Upon removing the pressure generated in the pressure path by the fluid supplies 14, the main valve is normally in the second position, and the main valve allows flow between the function port 16 and the venting port 26. As such, a backflow path may be provided for fluid escaping from the movable component 12 when the component 12 is actuated in a reversed direction by generating a flow of pressurized hydraulic fluid toward the second function port 18.

It should be noted that for the sake of simplicity, only portions of the hydraulic circuit 10 that are used for controlling the movable component 12 via the function port 16 have been described. However, persons skilled in the art, given the benefit of the present disclosure, will appreciate that the hydraulic circuit 10 may also include additional elements that provide complementary functionality to the control of the component 12 via the function port 18. Accordingly, pressurized hydraulic fluid flowing into the second function port 18 may actuate the component 12 in a second, reversed direction, for example, to open the blowout preventer, and expel hydraulic fluid stored in another chamber of the component 12 through the first function port 16.

Figure 3:
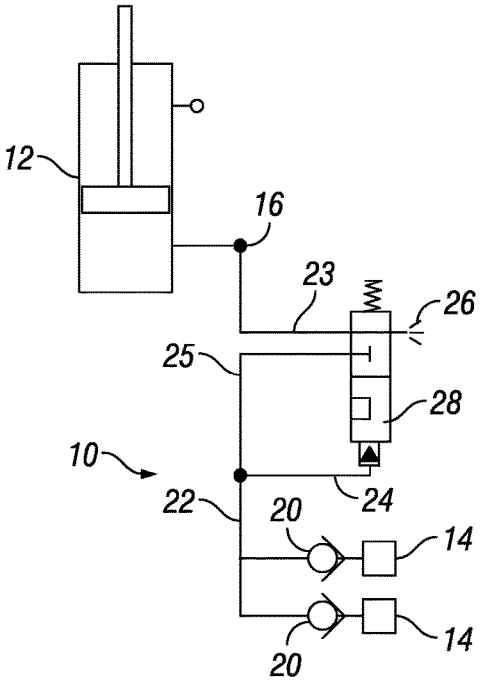
FIG. 3 is a schematic of a portion of a hydraulic circuit in accordance with an alternative to the embodiment shown in FIG. 2.

FIG. 3 is a schematic showing an example of a hydraulic circuit 10 in which the shuttle valve 66 (i.e., the main valve) shown in FIG. 2 is replaced by a three-way, two-position spool valve 28. The shuttle valves 66 shown in FIG. 2 and the three-way, two-position spool valve 28 shown in FIG. 3 function in essentially the same way, as further explained below.

The three-way, two-position spool valve 28 (i.e., the main valve) is fluidly coupled to the function port 16 via a port flowline 23. A supply flowline 25 is in fluid communication between the merging flowline 22 and the main valve. The pressure path includes a pilot line 24 connected between the merging flowline 22 and the main valve, upstream of the supply flowline 25. Note that in FIG. 3, the pilot line 24 and the supply flowline 25 are separate or distinct flowlines.

The main valve prevents flow through the supply flowline 25 when in the second position. As such, hydraulic fluid may only flow from at least one of the plurality of fluid supplies 14 into the function port 16 sequentially after the main valve is shifted in the first position. Upon supplying pressure in the pressure path, the pressure pilots the main valve and shifts the main valve to the first position. Only then, when the venting port 26 is sealed, hydraulic fluid may flow from at least one of the plurality of fluid supplies 14, through the main valve, through the port flowline 23, and into the function port 16.

To remove the pressure in the pressure path, pressure from all of the plurality of fluid supplies 14 may first be removed. Then, the pressure trapped between the check valves 20, and the main valve may also be dissipated so that the main valve may shift back to the second position, which is its normal position, for example upon the action of a spring. To dissipate the pressure trapped between the check valves 20 and the main valve, one or more of the check valves 20 may be implemented as bounce check valves, as explained in the description of FIGS. 14A-14C for example.

Figure 4:
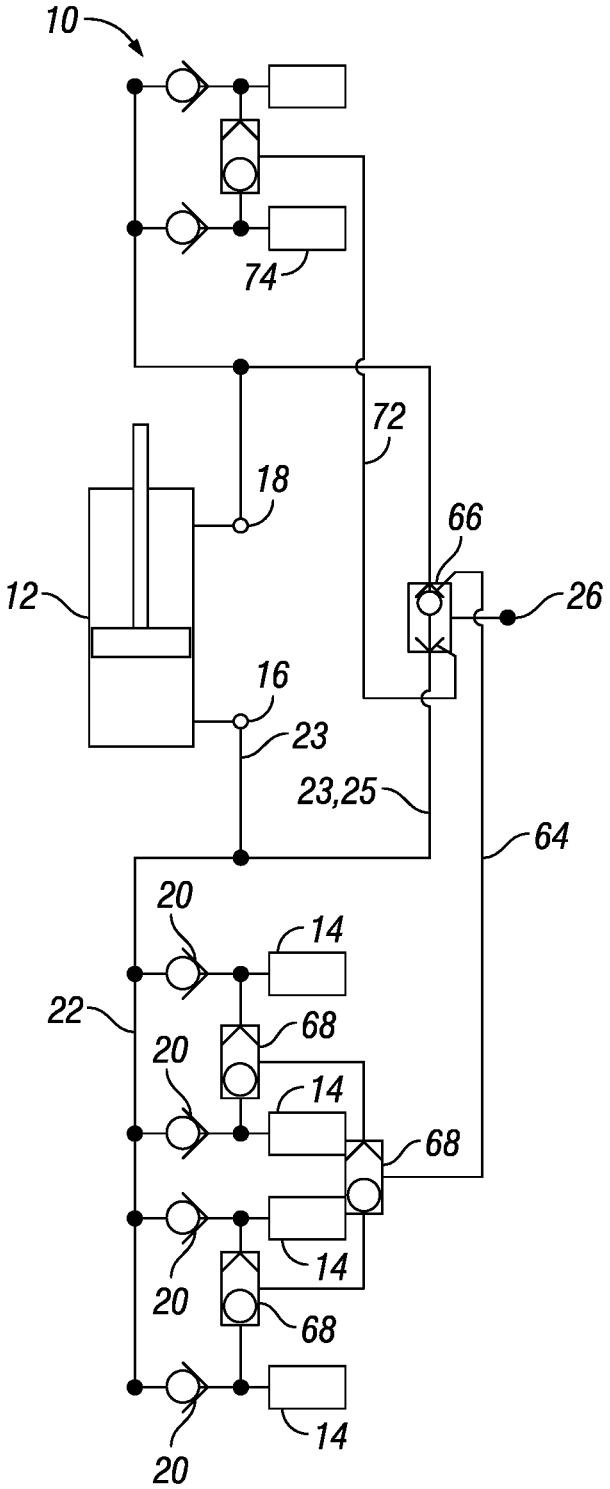
FIG. 4 is a schematic of a hydraulic circuit in accordance with an embodiment.

Turning now to FIG. 4, a hydraulic circuit 10 for controlling a movable component 12 using one or more of a plurality of fluid supplies 14 is illustrated. Similarly to FIG. 2, the hydraulic circuit 10 comprises a function port 16 fluidly coupled to the movable component, a venting port 26, and a main valve fluidly coupled between the function port 16 and the venting port 26. The main valve includes a shuttle valve 66 having a first position wherein the main valve prevents flow between the function port 16 and the venting port 26, and a second position wherein the main valve allows flow between the function port 16 and the venting port 26.

The hydraulic circuit 10 comprises a pressure path between at least one of the plurality of fluid supplies and the valve. Unlike in FIG. 2, the pressure path includes a pilot line 64 and one or more shuttle valves 68. Each shuttle valve 68 in the pressure path is in fluid communication between two of the plurality of fluid supplies 14. The communication with the two of the plurality of fluid supplies 14 is located upstream of the plurality of check valves 20. The pressure path illustrated in FIG. 4 may replace the pilot line 24 that is connected between the merging flowline 22 and the main valve as shown in FIGS. 2 and 3.

Further, the shuttle valve 66 (i.e., the main valve) is fluidly coupled to the function port 16 via the port flowline 23. The supply flowline 25 is in fluid communication between the merging flowline 22 and the main valve. Note that in FIG. 4, the supply flowline 25 and the port flowline 23 are partially implemented as a single flowline portion. Still further, the pressure in the fluid contained in the pilot lines 64 pilots the shuttle of the shuttle valve 66. Similarly, the pressure generated by a fluid supply 74 in the fluid contained in a pilot line 72 also pilots the shuttle of the shuttle valve 66. As such, the pressure in the pilot lines 64 and 72 determine the position of the shuttle in the shuttle valve 66.

In operation, upon any of the fluid supplies 14 generating a flow of pressurized hydraulic fluid, the cracking pressure of the plurality of check valves 20 may permit the pressure to buildup in the pressure path before hydraulic fluid flows into the merging flowline 22 toward the function port 16. The pressure may be sufficient to shift the main valve to the first position wherein the main valve prevents flow to the venting port 26. As such, hydraulic fluid may flow from at least one of the plurality of fluid supplies 14 into the function port 16 sequentially after the main valve is shifted to the first position.

Upon removing pressure from all of the plurality of fluid supplies 14, the pressure in the pilot line 64 may drop, and the main valve may shift back to its normal second position where hydraulic fluid is permitted to flow between the function port 16 and the venting port 26. When the main valve shifts to the second position, pressure trapped behind one of the one or more check valves 20 in the merging flowline 22 and the supply flowline 25 may also be dissipated through the venting port 26. In this example, the main valve is shifted to its normal position by fluid flow.

Figure 5:
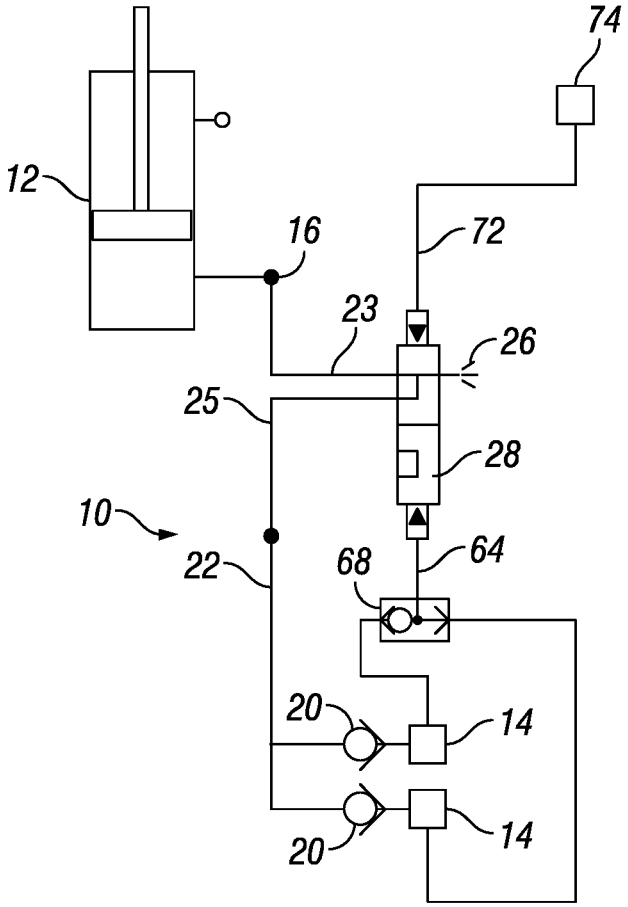
FIG. 5 is a schematic of a portion of a hydraulic circuit in accordance with an alternative to the embodiment shown in FIG. 4.

FIG. 5 is a schematic showing an example of a hydraulic circuit 10 in which the shuttle valve 66 (i.e., the main valve) shown in FIG. 4 is replaced by a three-way, two-position spool valve 28. The shuttle valves 66 shown in FIG. 4 and the three-way, two-position spool valve 28 shown in FIG. 5 function in essentially the same way, as further explained below.

In both positions of the three-way, two-position spool valve 28, hydraulic fluid can flow between the port flowline 23 and the supply flowline 25. The position of the valve 28 is determined by the pressure in the pilot lines 64 and 72.

Figure 6:
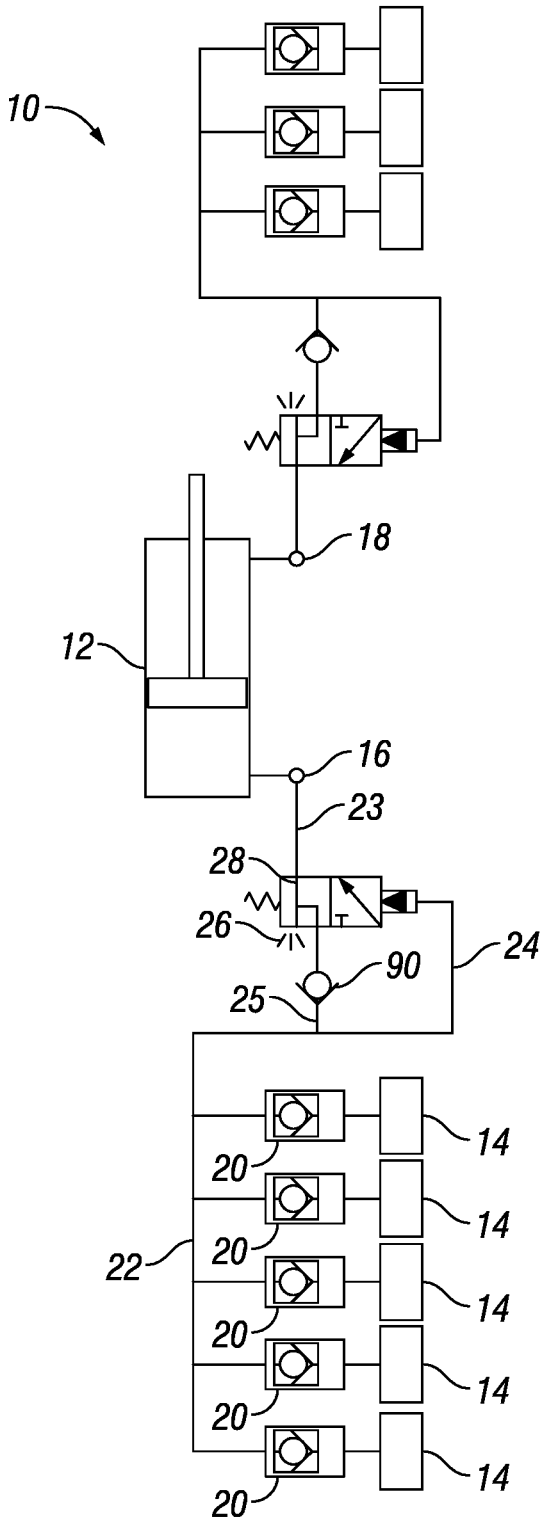
FIG. 6 is a schematic of a hydraulic circuit in accordance with an embodiment.

Turning now to FIG. 6, a hydraulic circuit 10 for controlling a movable component 12 using one or more of a plurality of fluid supplies 14 is illustrated. Similarly to FIG. 3, the hydraulic circuit 10 comprises a function port 16 fluidly coupled to the movable component, a venting port 26, and a main valve fluidly coupled between the function port 16 and the venting port 26. The main valve includes a three-way, two-position spool valve 28, having a first position wherein the main valve prevents flow between the function port 16 and the venting port 26, and a second position wherein the main valve allows flow between the function port 16 and the venting port 26. The supply flowline 25 is in fluid communication between the merging flowline 22 and the main valve. The hydraulic circuit 10 comprises a pressure path, such as a pilot line 24, between at least one of the plurality of fluid supplies and the main valve. For example, the pilot line 24 is connected between the merging flowline 22 and the main valve, upstream of the supply flowline 25.

Unlike in FIG. 3, the main valve does not prevent flow through the supply flowline 25 when in the second position. Thus, the function port 16, the flowline 23 and the supply flowline 25 remain in fluid communication whether the main valve is in the first position or the second position. Moreover, the supply flowline 25 includes a flow gate 90. The flow gate 90 allows the buildup of pressure in the merging flowline 22 and in the pressure path. For example, the flow gate 90 may comprise a check valve having a sufficient cracking pressure to allow pressure to build in flowline 22.

The buildup of pressure in the merging flowline 22 and in the pressure path generated by flow gate 90 causes the main valve to shift to the first position. In the first position, the flow between the function port 16 and the venting port 26 is prevented. Only then, when the venting port 26 is sealed, the flow gate 90 may open and hydraulic fluid may flow from the merging flowline 22, through the main valve, through the port flowline 23, and into the function port 16. Thus, hydraulic fluid from at least one of the plurality of fluid supplies 14 flows into the function port 16 sequentially after the main valve is shifted in the first position.

To remove the pressure in the pressure path, pressure from all of the plurality of fluid supplies 14 may first be removed. Then, the pressure trapped between the check valves 20 and the main valve may also be dissipated so that the main valve may shift back to the second position, which is its normal position, for example upon the action of a spring. To dissipate the pressure trapped between the check valves 20 and the main valve, one or more of the check valves 20 may be implemented as bounce check valves, as explained in the description of FIGS. 14A-14C. In addition, the flow gate 90 may be implemented as a check valve oriented to prevent fluid backflow from the function port 16 into the pilot line 24. As such, the bounce check valves may more efficiently dissipate the pressure trapped between the check valves 20 and the main valve, because the pressure is trapped in front of the flow gate 90 in a small volume that excludes the volume of the actuation chamber of the movable component 12.

Figure 7:
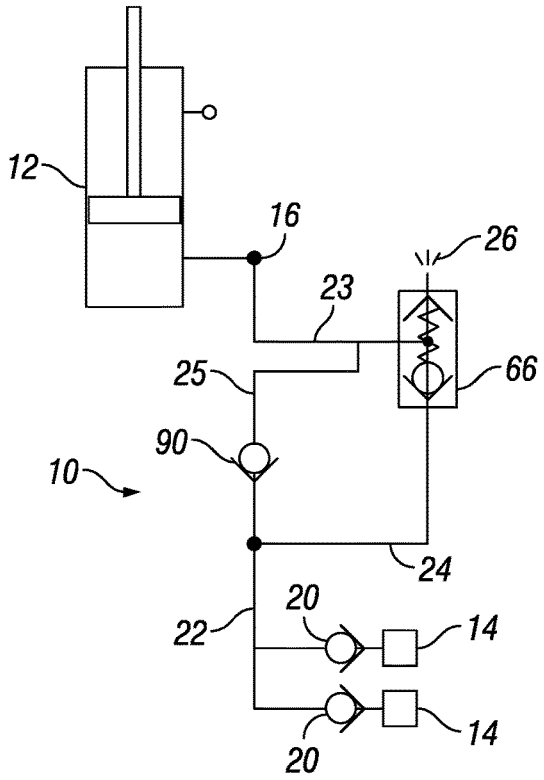
FIG. 7 is a schematic of a portion of a hydraulic circuit in accordance with an alternative to the embodiment shown in FIG. 6.

FIG. 7 is a schematic showing an example of a hydraulic circuit 10 in which the three-way, two-position spool valve 28 (i.e., the main valve) shown in FIG. 6 is replaced by a shuttle valve 66. The three-way, two-position spool valve 28 shown in FIG. 6 and the shuttle valves 66 shown in FIG. 7 function in essentially the same way, as further explained below.

Upon any of the fluid supplies 14 generating a flow of pressurized hydraulic fluid, the flow gate 90 may permit the pressure to buildup in the pilot line 24 and the shuttle valve 66 to close the venting port 26 before hydraulic fluid flows from the merging flowline 22 toward the function port 16.

In both positions of the shuttle valve 66, hydraulic fluid can flow between the port flowline 23 and the supply flowline 25. The position of the shuttle valve 66 is determined by the pressure in the pilot lines 24.

Figure 8:
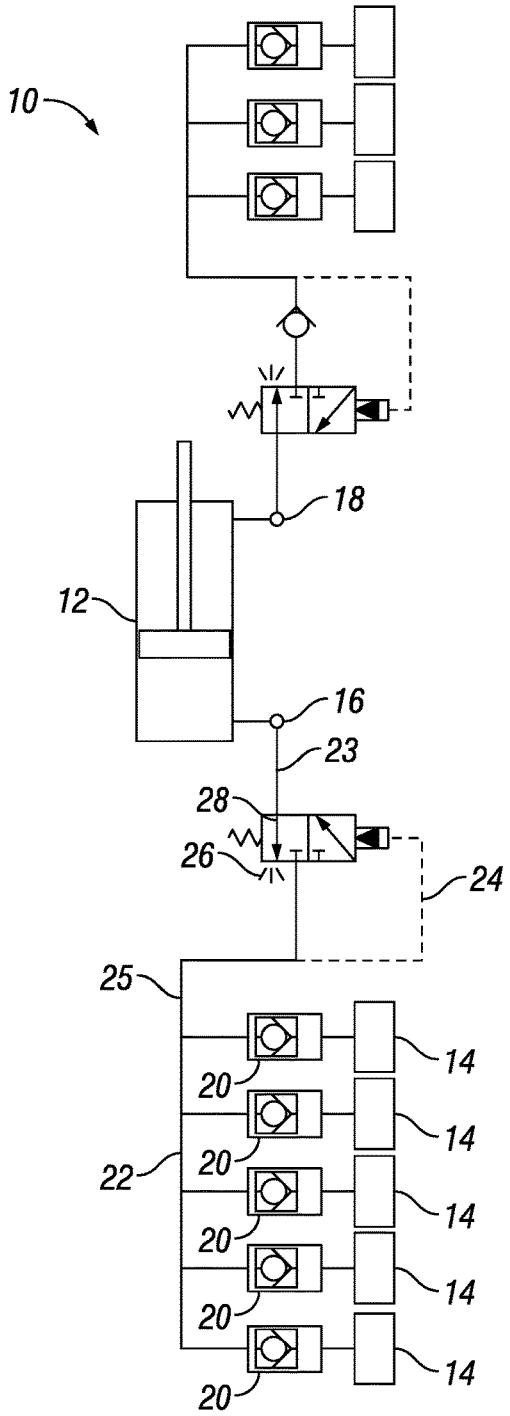
FIG. 8 is a schematic of a hydraulic circuit in accordance with an embodiment.

Turning now to FIG. 8, a hydraulic circuit 10 for controlling a movable component 12 using one or more of a plurality of fluid supplies 14 is illustrated.

Similarly to FIG. 6, the hydraulic circuit 10 comprises a function port 16, a venting port 26, and a main valve fluidly coupled between the function port 16 and the venting port 26. The main valve includes a three-way, two-position spool valve 28, having a first position wherein the main valve prevents flow between the function port 16 and the venting port 26, and a second position wherein the main valve allows flow between the function port 16 and the venting port 26. The supply flowline 25 is in fluid communication between the merging flowline 22 and the main valve. The hydraulic circuit 10 comprises a pressure path, such as a pilot line 24, between at least one of the plurality of fluid supplies and the main valve. For example, the pilot line 24 is connected between the merging flowline 22 and the main valve, upstream of the supply flowline 25. The pressure in the pressure path pilots a spool of the valve 28.

Unlike in FIG. 6, the flow gate 90 is not implemented in the hydraulic circuit 10. Moreover, the configuration of the main valve is similar to the configuration of the main valve shown in FIG. 3. Accordingly, the main valve may be connected to the supply flowline 25, the venting port 26 and the function port 16 (via the port flowline 23). In the first position, the main valve allows flow between the supply flowline 25 and the function port 16. In the second position, the main valve prevents flow between the supply flowline 25 the function port 16.

Figure 9:
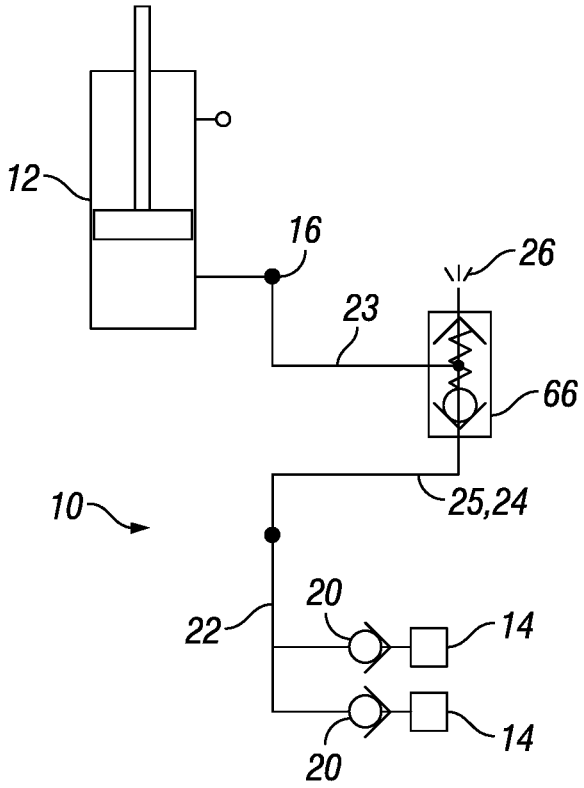
FIG. 9 is a schematic of a portion of a hydraulic circuit in accordance with an alternative to the embodiment shown in FIG. 8.

FIG. 9 is a schematic showing an example of a hydraulic circuit 10 in which the three-way, two-position spool valve 28 (i.e., the main valve) shown in FIG. 8 is replaced by a shuttle valve 66. The three-way, two-position spool valve 28 shown in FIG. 8 and the shuttle valves 66 shown in FIG. 9 function in essentially the same way, as further explained below.

The main valve is fluidly coupled to the function port 16 via the port flowline 23. The supply flowline 25 is in fluid communication between the merging flowline 22 and the main valve. The pilot line 24 is connected between the merging flowline 22 and the main valve, upstream of the supply flowline 25. Note that the pilot line 24 provides the supply flowline 25 that fluidly couples the function port 16 and the merging flowline 22 when the main valve is in the first position.

Figure 10:
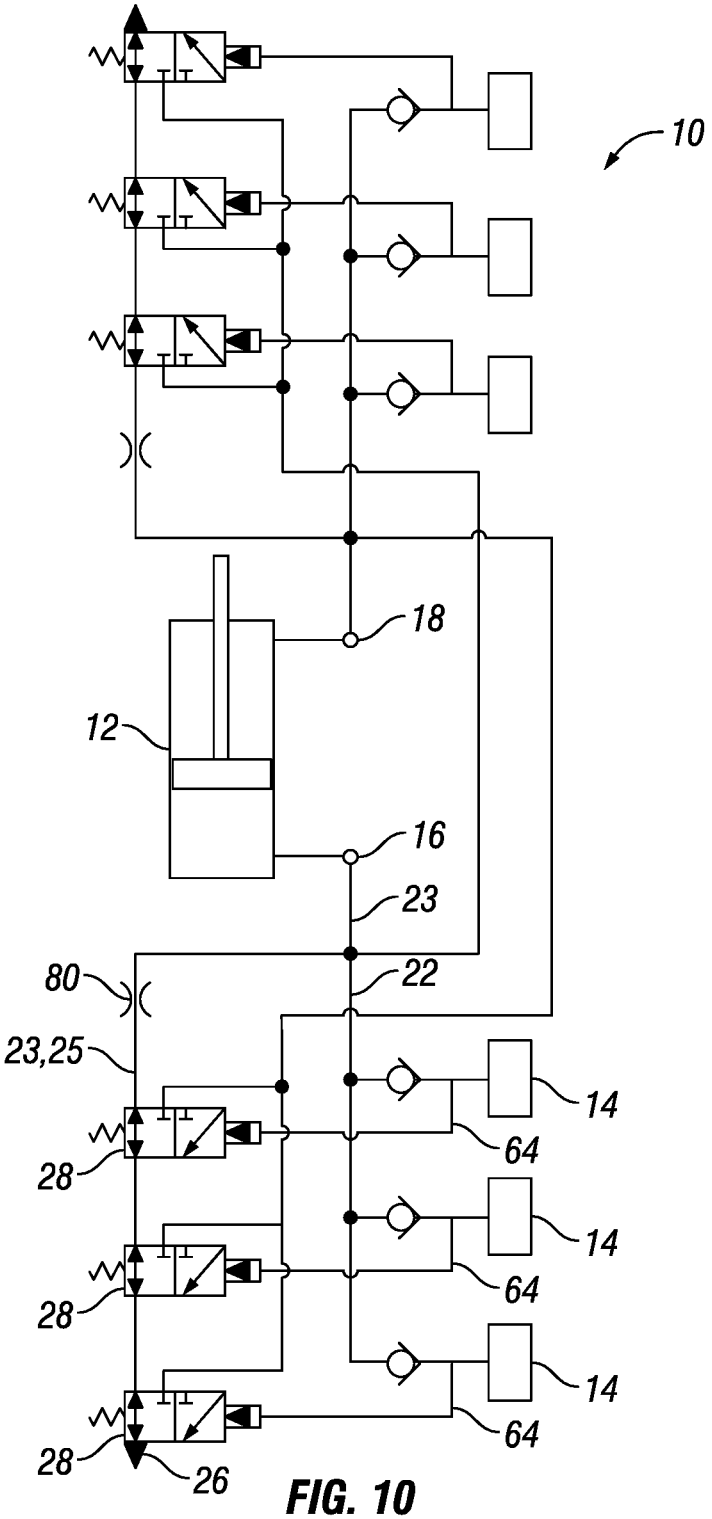
FIG. 10 is a schematic of a hydraulic circuit in accordance with an embodiment.

FIG. 10 shows a hydraulic circuit 10 for controlling a component 12 of a blowout preventer using one or more of a plurality of fluid supplies 14. A function port 16 is fluidly coupled to the component 12 of the blowout preventer. Hydraulic fluid in the circuit 10 may be discharged via a venting port 26. A plurality of check valves 20 is coupled to a corresponding one of the plurality of fluid supplies 14 and is oriented to prevent fluid backflow towards the corresponding fluid supply. A plurality of pilot lines 64 having fluid therein are in pressure communication with a corresponding one of the fluid supplies 14 upstream of the corresponding one of the plurality of check valves 20. A merging flowline 22 fluidly couples the plurality of check valves 20. A port flowline 23 fluidly couples the function port 16 and a plurality of main valves 28.

The plurality of valves 28 are fluidly coupled in series between the function port 16 and the venting port 26. Each one of the plurality of valves 28 is in pressure communication with the fluid in a corresponding one of the plurality of pilot lines 64. Each one of the plurality of valves 28 has a first position wherein the main valve prevents flow between the function port 16 and the venting port 26, and a second position wherein the main valve allows flow between the function port 16 and the venting port 26. A supply flowline 25 fluidly couples the merging flowline 22 to the plurality of valves 28. Note that in FIG. 10, the supply flowline 25 and the port flowline 23 are partially implemented as a single flowline portion.

As shown in FIG. 10, at least one of the plurality of valves 28 may be a 3-way, 2-position spool valve. Each one of the plurality of valves 28 is normally shifted in the second position, that is, fluid may flow from the function port 16 to the venting port 26. Thus, when none of the fluid supplies 14 provides pressurized fluid upstream of the check valves 20, the function port 16 is in fluid communication with the venting port 26, and pressure may not remain trapped in the flowline 22 or in an actuation chamber of component 12 coupled to the function port 16.

Each one of the plurality of valves 28 is shifted to the first position upon applying pressure to the fluid in the corresponding one of the pilot lines 64. Thus, when any of the plurality of fluid supplies 14 generates flow of pressurized hydraulic fluid into the first function port 16 through one or more of the plurality of check valves 20, the pressure in the fluid in the corresponding one of the pilot lines 64 increases and the corresponding one of the plurality of valves 28 shifts to the first position and prevents fluid flow from the flowline 22 toward the venting port 26. The pressure level required to shift the valves 28 in the first position is preferably lower than the cracking pressure of the check valves 20. In addition, an optional flow resistor 80 may be provided in the flowline 22 upstream of the valves 28 to further buildup pressure in the hydraulic circuit 10 when fluid is discharged through the venting port 26 and facilitate shifting of the valves 28. Thus, closure of the venting port 26, closure of the flowline 23, and flow into the function port 16 may be ensured.

The hydraulic circuit 10 of FIG. 10 may be more tolerant to faulty valves than other alternatives due to the valves 28 being mounted in series between the flowline 22 and the venting port 26. In such series configuration, only one of the valves 28 functioning properly may be sufficient to ensure closure of the venting port 26 and flow of hydraulic fluid toward the function port 16 of the component 12 (and not toward the venting port 26).

The hydraulic circuits 10 of FIGS. 2-10 may also include additional elements that provide complementary functionality for the control of the component 12 via the function port 18. Moreover, the number of fluid supplies illustrated in the hydraulic circuits 10 of FIGS. 2-10 may be reduced or increased from the number shown in the Figures.

Figure 11:
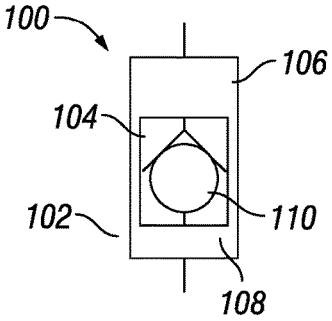
FIG. 11 is a schematic of a bounce check valve in accordance with a first embodiment.
Figure 12:
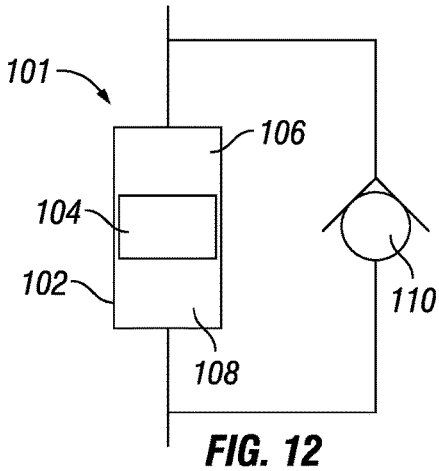
FIG. 12 is a schematic of a bounce check valve in accordance with a second embodiment.

Turning now to FIGS. 11 and 12, examples of bounce check valves are illustrated. Each one of the bounce check valves 100 and 101 includes a vessel 102, a piston 104 separating two chambers 106 and 108 of the vessel 102, and a valve 110 in fluid communication between the two chambers 106 and 108. The valve 110 restricts fluid flow across the valve to one direction. In the embodiment of FIG. 11, the valve is integrated into the piston 104. However, the valve 110 may alternatively be separate from the piston 104 and the vessel 102, for example as illustrated in the embodiment of FIG. 12. Bounce check valves 100 and 101 function similarly.

Figure 13A:
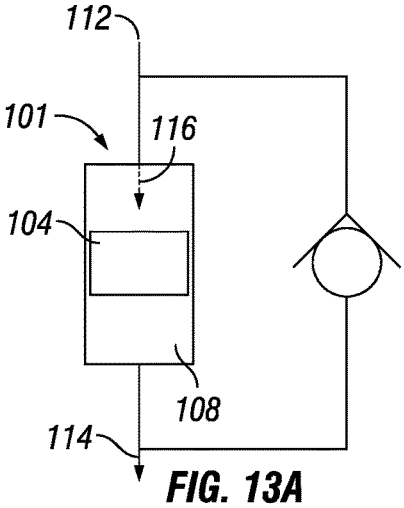
FIGS. 13A-13C illustrate an operational sequence of the bounce check valve shown in FIG. 12.
Figure 13B:
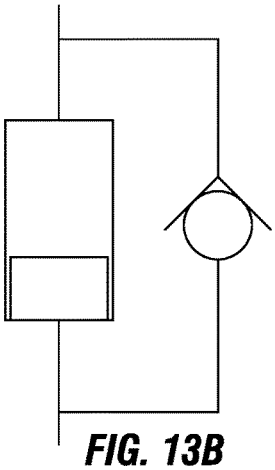
Figure 13C:
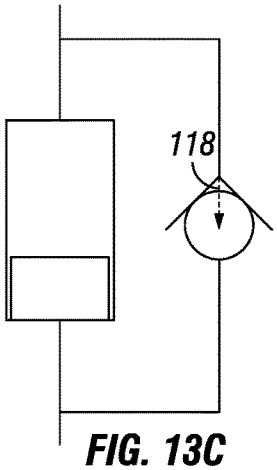

FIGS. 13A-13C illustrate an operational sequence of the bounce check valve 101 in which hydraulic fluid flows from an inlet 112 of the bounce check valve 101, toward an outlet 114 of the bounce check valve 101. In FIG. 13A, the flow of hydraulic fluid may initially not develop sufficient pressure across the valve 110 to open it. As such, the flow of hydraulic fluid may displace the piston 104 in the vessel 102, as indicated by arrow 116. The displacement may continue until the piston 104 reaches an end of stroke position within the vessel 102, as shown in FIG. 13B. At this point, the hydraulic fluid flow may build up pressure on the side of the inlet 112. When the pressure is sufficient to open the valve 110, hydraulic fluid may flow through the valve 110 and toward the outlet 114, as indicated by the arrow 118 in FIG. 13C. Thus, the piston 104 may be located an end of stroke position within the vessel 102 when the flow is established across the bounce check valve 101.

Figure 14A:
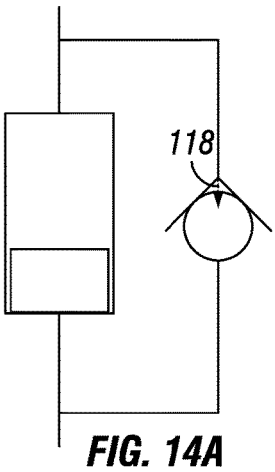
FIGS. 14A-14C illustrate another operational sequence of the bounce check valve shown in FIG. 12.
Figure 14B:
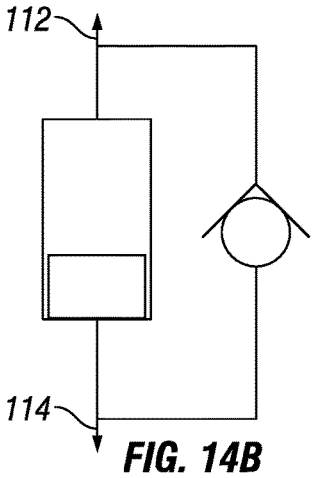
Figure 14C:
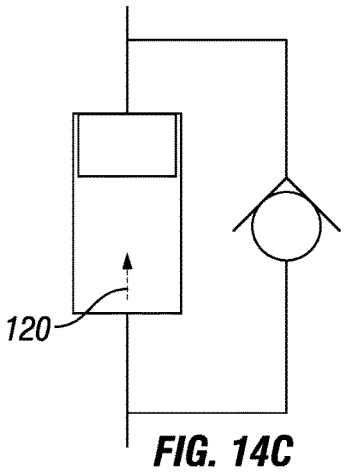

FIGS. 14A-14C illustrate another operational sequence of the bounce check valve 101 in which hydraulic fluid flow from the inlet 112 toward from the outlet 114 is interrupted, and pressure trapped behind the bounce check valve 101 is dissipated. When the flow of hydraulic fluid across the valve 110 stops, the valve 110 closes and prevent backflow through the valve 110 from the outlet 114 toward the inlet 112, as shown in FIG. 14B. While the valve 110 remains close, some fluid may flow into the outlet 114, and out of the inlet 112 and displace the piston 104, as illustrated by the arrow 120 in FIG. 14C, at least until the piston 104 reaches another end of stroke position within the vessel 102. During the displacement of the piston 104, the pressure at the inlet 112 and the outlet 114 are equalized. Thus, as the pressure at the inlet 112 is removed, the pressure at the outlet 114 is dissipated.

While the disclosure is susceptible to various modifications and alternative forms, specific embodiments thereof are shown by way of example in the drawings and description. It should be understood, however, that the drawings and detailed description thereto are not intended to limit the claims to the particular form disclosed, but on the contrary, the intention is to cover all modifications, equivalents and alternatives falling within the scope of the claims.

What is claimed is:

1. A hydraulic circuit for controlling a movable component using one or more of a plurality of fluid supplies, comprising:

a plurality of check valves, each one of the plurality of check valves fluidly coupled to a corresponding one of the plurality of fluid supplies and oriented to prevent fluid backflow toward the corresponding fluid supply;

a first flowline in fluid communication between the plurality of fluid supplies downstream of the corresponding one of the plurality of check valves;

a function port fluidly coupled to the movable component;

a venting port;

a valve fluidly coupled between the function port and the venting port, the valve having a first position wherein the valve prevents flow between the function port and the venting port, and a second position wherein the valve allows flow between the function port and the venting port;

a pressure path between at least one of the plurality of fluid supplies and the valve; and a second flowline fluidly coupling the valve and the first flowline, wherein the valve is normally in the second position upon removing pressure in the pressure path, and wherein the valve is shifted to the first position upon supplying pressure in the pressure path.

2. The hydraulic circuit of claim 1, wherein the plurality of check valves comprise bounce check valves.

3. The hydraulic circuit of claim 1:

wherein the valve comprises a plurality of valves fluidly coupled in series between the function port and the venting port, each one of the plurality of valves having a first position wherein flow between the function port and the venting port is prevented and a second position wherein flow between the function port and the venting port is allowed, and each one of the plurality of valves being normally in the second position, wherein the pressure path comprises a plurality of pilot lines having fluid therein, each one of the plurality of pilot lines being in pressure communication with a corresponding one of the fluid supplies upstream of the corresponding one of the plurality of check valves, each one of the plurality of valves being in pressure communication with the fluid in a corresponding one of the plurality of pilot lines, and wherein each one of the plurality of valves is shifted to the first position upon applying pressure to the fluid in the corresponding one of the pilot lines.

4. The hydraulic circuit of claim 1, wherein:

the pressure path includes a pilot line connected between the first flowline and the valve upstream of the second flowline, and the second flowline includes a flow gate.

5. The hydraulic circuit of claim 2, wherein:

the pressure path includes a pilot line connected between the first flowline and the valve upstream of the second flowline, and the second flowline includes a flow gate.

6. The hydraulic circuit of claim 4, wherein the flow gate comprises a check valve oriented to prevent fluid backflow from the function port into the pressure path.

7. The hydraulic circuit of claim 5, wherein the flow gate comprises a check valve oriented to prevent fluid backflow from the function port into the pressure path.

8. The hydraulic circuit of claim 1, wherein:

the valve comprises a three-way valve connected to the second flowline, the venting port, and the function port, the three-way valve further allows flow between the second flowline and the function port in the first position, the three-way valve further prevents flow between the second flowline and the function port in the second position, and pressure in the pressure path pilots a spool of the three-way valve.

9. The hydraulic circuit of claim 2, wherein:

the valve comprises a three-way valve connected to the second flowline, the venting port, and the function port, the three-way valve further allows flow between the second flowline and the function port in the first position, the three-way valve further prevents flow between the second flowline and the function port in the second position, and pressure in the pressure path pilots a spool of the three-way valve.

10. The hydraulic circuit of claim 1, wherein:

the valve comprises a shuttle valve, the pressure path provides the second flowline fluidly, the second flowline further couples the function port and the first flowline when the shuttle valve is in the first position, and the shuttle valve prevents flow through the second flowline in the second position.

11. The hydraulic circuit of claim 2, wherein:

the valve comprises a shuttle valve, the pressure path provides the second flowline, the second flowline further fluidly couples the function port and the first flowline when the shuttle valve is in the first position, and the shuttle valve prevents flow through the second flowline in the second position.

12. The hydraulic circuit of claim 1, wherein the pressure path comprises a shuttle valve in fluid communication between two of the plurality of fluid supplies upstream of the plurality of check valves.

13. The hydraulic circuit of claim 12, wherein:

the valve comprises a shuttle valve, and pressure in the pressure path pilots a shuttle of the shuttle valve.

14. A method of controlling a movable component using one or more of a plurality of fluid supplies, comprising:

fluidly coupling a function port to the movable component;

fluidly coupling a valve between the function port and a venting port, the valve having a first position wherein the valve prevents flow between the function port and the venting port, and a second position wherein the valve allows flow between the function port and the venting port;

providing a pressure path between at least one of the plurality of fluid supplies and the valve, preventing fluid backflow toward any of the plurality of fluid supplies using one or more check valves;

shifting the valve in the second position upon removing pressure in the pressure path;

shifting the valve in the first position upon supplying pressure in the pressure path; and flowing hydraulic fluid from the at least one of the plurality of fluid supplies into the function port sequentially after the valve being shifted in the first position.

15. The method of claim 14 wherein removing pressure in the pressure path comprises removing pressure from all of the plurality of fluid supplies, and wherein supplying pressure in the pressure path comprises supplying pressure with any of the plurality of fluid supplies.

16. The method of claim 14 wherein removing the pressure in the pressure path comprises dissipating the pressure trapped behind one of the one or more check valves using a bounce check valve.

* * * * *